United States Patent [19]

Fraser

[11] 4,087,168

[45] May 2, 1978

[54] CHARGING SYSTEM FOR ELECTROSTATIC REPRODUCTION MACHINE

[75] Inventor: Lawrence J. Fraser, Rochester, N.Y.

[73] Assignee: Xerox Corporation, Stamford, Conn.

[21] Appl. No.: 650,399

[22] Filed: Jan. 19, 1976

[51] Int. Cl.[2] ..... G03G 15/00; G03G 15/02

[52] U.S. Cl. ..... 355/3 CH; 355/3 R; 96/1 C

[58] Field of Search ..... 355/3 CH, 3 R, 3 DD; 96/1 C, 1 R, 1.4

[56] References Cited

U.S. PATENT DOCUMENTS

| | | | |
|---|---|---|---|
| 3,730,709 | 5/1973 | Kinoshita et al. | 355/3 R |
| 3,793,016 | 2/1974 | Eichorn | 355/3 R |
| 3,794,550 | 2/1974 | Taillie | 161/147 |
| 3,967,891 | 7/1976 | Rippstein | 355/3 CH |
| 3,997,259 | 12/1976 | Bhagat | 96/1 C |

FOREIGN PATENT DOCUMENTS

| | | | |
|---|---|---|---|
| 1,963,615 | 7/1970 | Germany | 96/1 C |

*Primary Examiner*—L. T. Hix
*Assistant Examiner*—W. J. Brady

[57] ABSTRACT

A xerographic system, particularly color, is disclosed. To offset the side effects of the relatively high bias potentials applied to the magnetic brush developer roll or rolls and the tendency thereof to create fields adverse to edge and fringe development, a field sensitive corona generating device is provided to raise potentials of the image background areas after exposure but before development.

2 Claims, 7 Drawing Figures

CHARGING SYSTEM FOR ELECTROSTATIC REPRODUCTION MACHINE

This invention relates to electrostatic reproduction systems, and more particularly, to an improved development system for electrostatic reproduction machines.

In color xerography, unwanted low potential electrostatic images are produced on the photoreceptor by unwanted color components due to non-ideal filters and light sources. To offset this phenomena, relatively high bias potentials are applied to the magnetic developing brush or brushes; this in an effort to suppress development of such unwanted images. However, use of relatively high developer biases may cause a strong field to be set up between the developing brush roller carrying the relatively high voltage potential and the image background areas, the charge potential of which after exposure is greatly reduced. This field tends to drive toner in the developer blanket back toward the magnetic brush roller with resultant edge deletion of the solid areas and possible build up of toner on the developing brush with consequent isolation of the developing brush from the effects of the bias applied thereto.

While the relatively high developer biases alluded to earlier can help control unwanted development of the image solid areas, development suppression control of both line copy and the fringes of solids may be inadequate. This latter, which is due to the strong fringe field development capability inherent in xerography, may result in color contamination in lines and edges of solids in color systems.

It is therefore a principal object of the present invention to provide a new and improved electrostatic type reproduction or copying system.

It is a further object of the present invention to control the formation of electromagnetic fields in a biased developing system.

It is an object of the present invention to provide apparatus sensitive to the manifold charge levels that comprise an electrostatic image and which increases the charge levels of those image areas, nominally background, below a predetermined charge level to reduce the tendency for undesired electromagnetic fields to be created.

It is a further object of the present invention to provide a new and improved image developing control.

It is an object of the present invention to provide means effective to control the electromagnetic fields established between the magnetic developing brush or brushes and the electrostatic image areas.

It is an object of the present invention to provide, in an electrostatic type reproduction system, an electrostatic field sensitive corona generator adapted to treat background areas of the electrostatic latent image and raise the charge level of such areas to reduce the tendency for the formation of strong electromagnetic fields due to the disparity between the image charge level and the developer bias.

This invention relates to an electrostatic reproduction machine comprising in combination: a photoconductive member; first charging means to place a uniform electrostatic charge on the surface of a photoconductive member in preparation for imaging; exposure means to expose the photoconductive member to an original being reproduced and thereby selectively discharge the photoconductive member in accordance with the original being reproduced to form a latent electrostatic image of the original on the photoconductive member; and, second charging means to restore at least a part of the charge on the exposed area of the latent electrostatic image to thereby reduce the charge differential between exposed and nonexposed areas.

Other objects and advantages will be apparent from the ensuing description and drawings in which.

For a general understanding of the present invention, an exemplary color reproducing machine, designated generally by the numeral 8, is herein described. Other machine types and configurations may, however, be envisioned.

Figure 1:
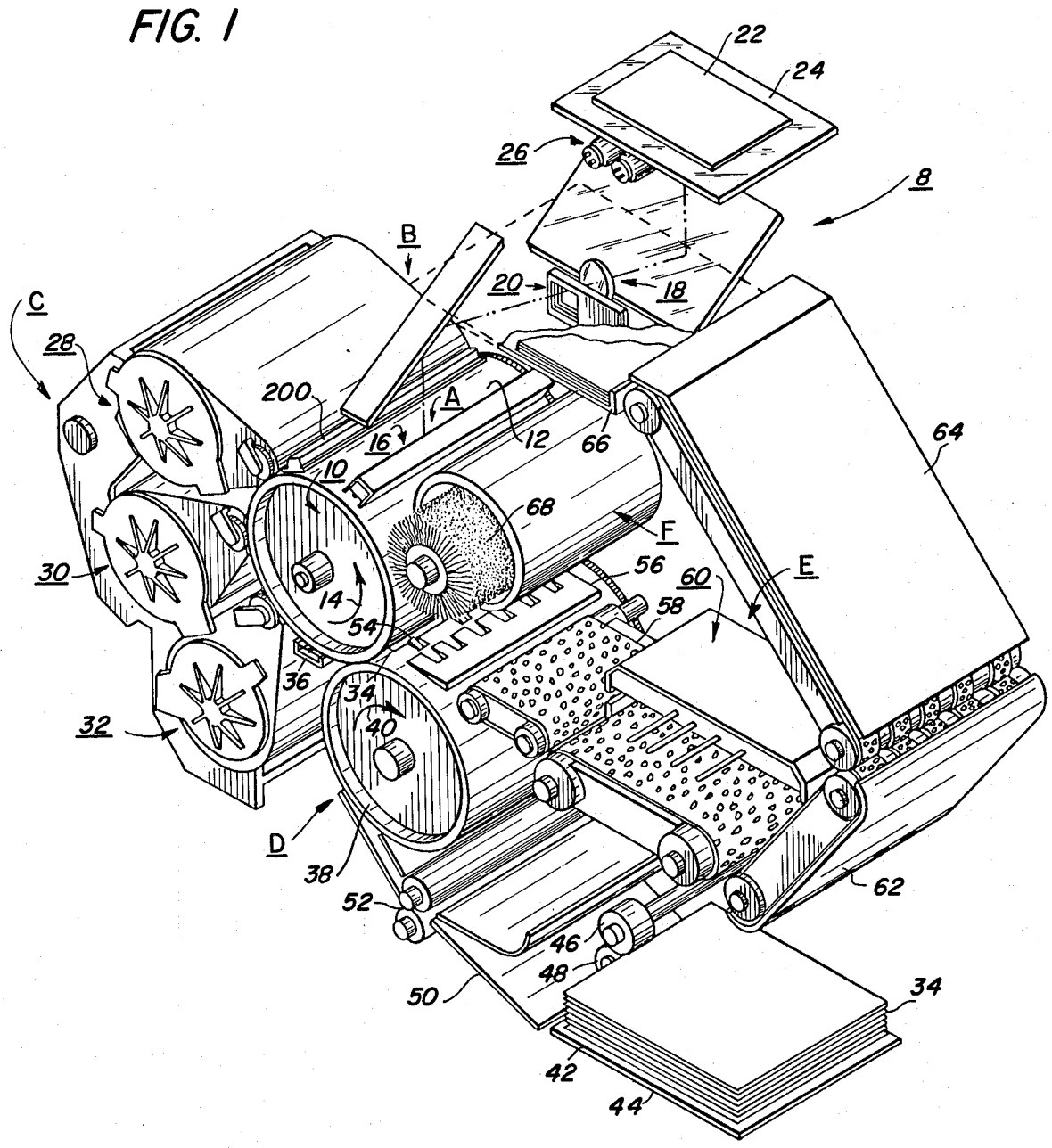
FIG. 1 is a schematic perspective view of an exemplary color electrophotographic printing machine incorporating the present invention.

Referring to FIG. 1, color reproducing machine 8 comprises an electrophotographic printing machine having a rotatable photoconductive member in the form of a drum 10. A series of xerographic processing stations are operatively disposed about drum 10, drum 10 turning in the direction shown by the arrow 14. Drum 10 is rotated at a predetermined speed relative to the other machine operating components, suitable timing means (not shown) being provided to integrate operation of the various xerographic processing components with rotation of drum 10 to form an operative color reproducing machine as will be understood by those skilled in the art.

A corona generating device indicated generally at 16 and extending longitudinally in a transverse direction across the photoconductive surface 12 of drum 10 serves to charge the photoconductive surface 12 to a uniform charge preparatory to imaging, at charging station A.

An exposure station B is downstream of corona generating device 16. There a color filtered light image of an original document 22 is projected onto the charged photoconductive surface 12. Exposure station B includes a moving lens system, designated generally by the reference numeral 18, and a color filter mechanism shown generally at 20. Original document 22, which may comprise a sheet of paper, book or the like is placed face down on a transparent viewing platen 24. Exposure lamps 26 which are adapted to move in timed relation with lens 18 and filter mechanism 20 to scan successive incremental areas of original document 22 disposed upon platen 24 are disposed below platen 24. The light image of the original document 22 created is projected onto the photoconductive surface 12, through lens 18 and filter mechanism 20, the latter interposing selected color filters into the optical path of lens 18 during the exposure process as will appear.

Following exposure, the image is developed at station C. There individual developers units 28, 30, 32 are operated selectively to render visible the electrostatic latent images recorded on photoconductive surface 12. Developer units 28, 30, 32 each comprise a magnetic brush type developing unit with the developing material comprising a magnetizable mix of carrier granules and heat settable toner particles.

During development, the developer mix is brought through a directional flux field to create a brush thereof in operative contact with the electrostatic latent image on the photoconductive surface 12. Toner particles are attracted electrostatically from the developer mix to the latent image.

Each of the developer units 28, 30, 32 contain appropriately colored toner particles. For example, developer unit 28 may have yellow toner particles for developing a blue filtered electrostatic image, developer unit 30 cyan toner particles for developing a red filtered latent image, and developer unit 32 magenta toner particles for developing a green filtered latent image.

At transfer station D, the powder image adhering electrostatically to the photoconductive surface 12 is transferred to a final support material such as paper sheet 34. Transfer station D includes corona generating means 36 and a transfer roll 38. Corona generator 36 serves to precondition the toner image to enhance transfer from photoconductive surface 12 to sheet 34. Transfer roll 38 brings the sheet into transfer relation with the photoconductive surface 12, roll 38 being electrically biased to a potential of sufficient magnitude and polarity to attract electrostatically toner particles from photoconductive image 12 to sheet 34. Transfer roll 38 rotates in synchronism with drum 10 to maintain image registration between successive images, roll 38 normally rotating the number of times necessary to complete transfer of one full color image. Transfer roll 38 rotates in the direction of arrow 40 at substantially the same angular velocity as drum 10.

Sheets 34 are advanced one by one from a stack 42 thereof in supply tray 44. A feed roll 46 which cooperates with retard roll 48 to limit feeding to one sheet at a time, advances the sheets forward from stack 42. The advancing sheet passes through chute 50 into the pin formed by register roll pair 52. Thereafter, gripper fingers 54 on transfer roll 38 grasp the sheet 34 for rotation with roll 38. After the requisite number of toner powder images have been transferred to the sheet 34, fingers 34 release the sheet 38 for transfer to fuser 60. Stripper bar 56 facilitates separation of the sheet from transfer roll 38 and onto conveyor 58 which carries the sheet to fuser 60 at fixing station E. There, the transferred powder image is permanently fused onto sheet 34. After fusing, the sheet 34 is advanced by conveyors 62, 64 to copy output tray 66.

Residual toner particles left on drum 10 are removed from the photoconductive surface 12 cleaning station F. To enhance cleaning, a corona generating device (not shown) is provided to neutralize the electrostatic charges remaining on the residual toner particles and on photoconductive surface 12. The neutralized toner particles are then cleaned from photoconductive surface 12 by rotating brush 68.

Figure 2:
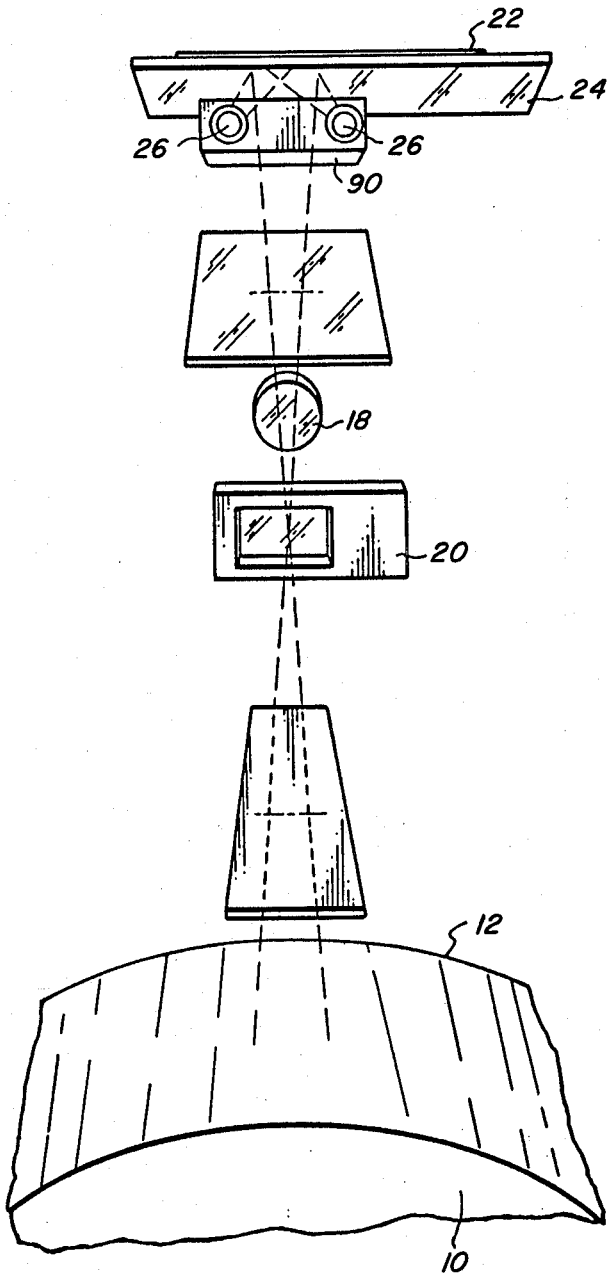
FIG. 2 is a schematic illustration of the optical system of the printing machine shown in FIG. 1.

Turning now to FIG. 2, exposure lamps 26 are carried on a reciprocably supported lamp carriage 90. Carriage 90 traverses back and forth below platen 24 illuminating incremental widths of the original document 22 disposed thereon. Suitable drive means (not shown) are provided to drive carriage 90. Lens 18 is supported for reciprocatory movement in unison with lamp carriage 90.

Filter assembly 20 is coupled to lens 18 for movement therewith. As a result, lamp 26, lens 18 and filter 20 scan the original document 22 to create a flowing light image thereof, filter 22 interposing selected color filters to create a single color latent electrostatic image on the photoconductive surface 12. On reaching the end of the path of scan, lens 18, filter 20 and lamps 26 are returned to their original position for start of the next cycle.

Filter 20 incorporates blue, red and green filters, each supported for selective movement into the light path to provide the desired color separation. Suitable drive means (not shown) are provided to move the filters individually into and out of operative position. As described, each of the filters is associated with toner particles, complementary of the color thereof to produce a substractive system, i.e. a blue filtered light image is developed with yellow toner particles (developer unit 28), a red filtered light image is developed with cyan toner particles, (developer unit 30) and a green filtered light image is developed with magenta toner particles (developer unit 32).

Figure 3:
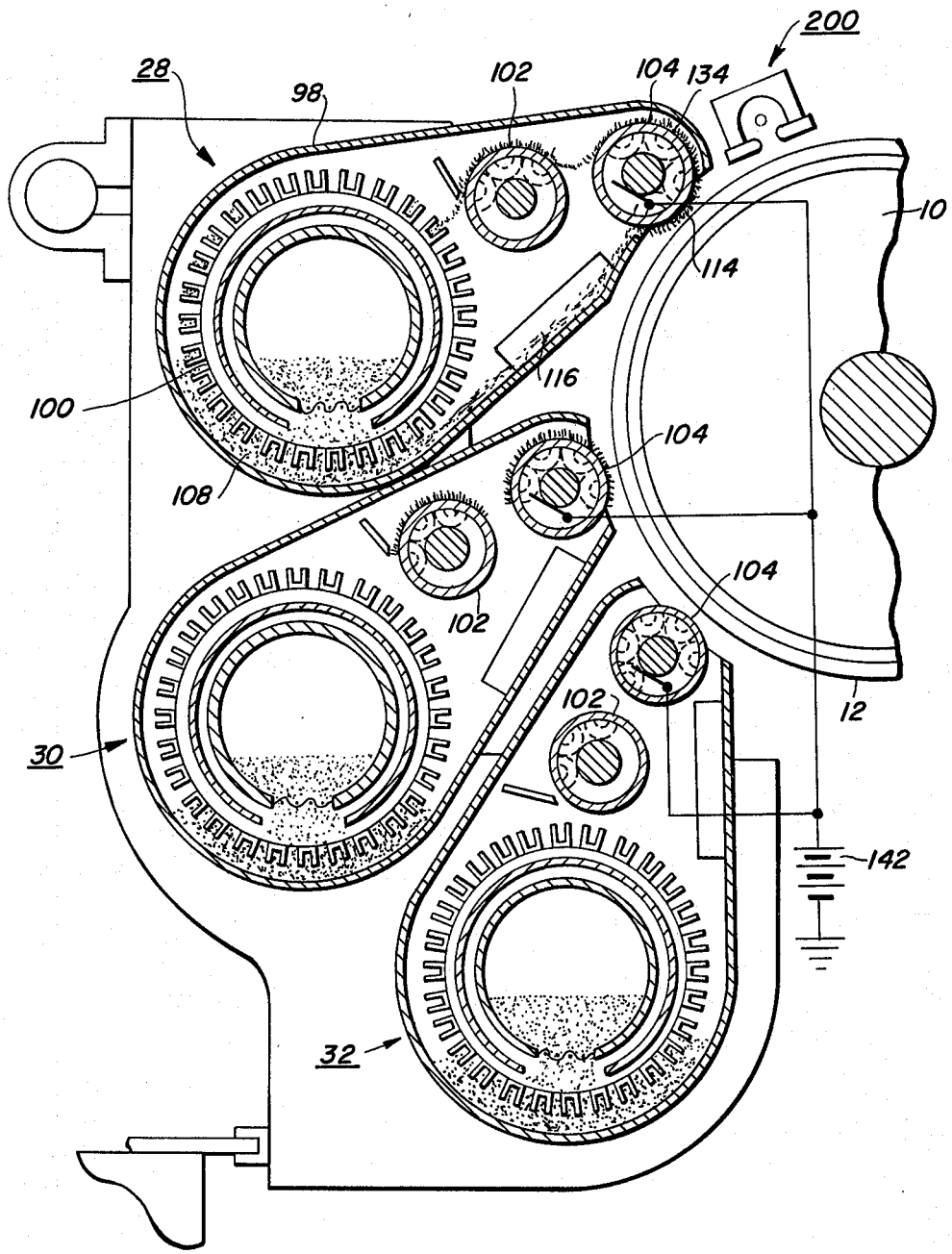
FIG. 3 is a sectional elevational view of the development system of the printing machine shown in FIG. 1.
Figure 4:
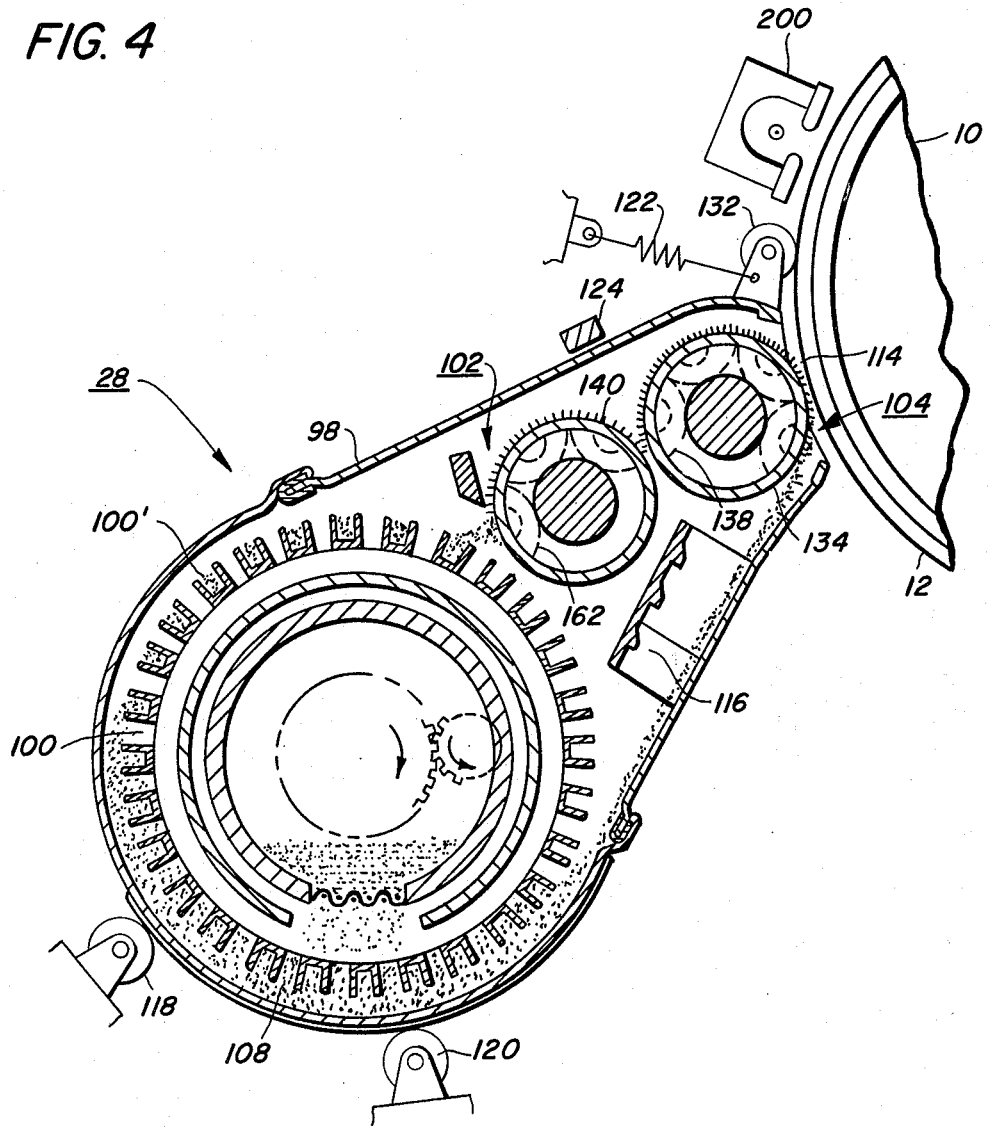
FIG. 4 is a fragmentary sectional elevational view depicting in detail one of the developer units that comprise the development system for the machine shown in FIG. 1.

Referring now to FIGS. 3 and 4, magnetic brush developer unit 28 includes a housing 98 within which a supply of developer mix 108 is contained, conveyor 100, intermediate transport roll 102, and developer roll 104. Conveyor 100 comprises a cylindrical member having buckets or scoops 100' about the periphery thereof for bringing developer mix 108 from the sump region of housing 98 into proximity with intermediate transport roll 102.

Circulation of developer mix 108 within housing 98 generates a triboelectric charge between the carrier granules and toner particles that comprise the developer mix. As the developer mix 108 approaches transport roll 102, the magnetic field produced by the internal magnets 162 therein attract the mix 108 to the surface thereof. Transport roll 102 carries the developer mix 108 upwardly into proximity with developer roll 104.

As will be understood by those skilled in the art, the electrostatic latent image on photoconductive surface 12 is developed by contact with the developer mix 108, the charged areas of photoconductive surface 12 electrostatically attracting the toner particles from the carrier granules. The developer mix returns via mixing baffle 116, to the housing sump region for replenishing of the used toner particles.

Developer housing 98 is arranged to pivot about the axis of conveyor 100, the housing being supported by rollers 118, 120. Spring 122 biases developer housing 98 against stop 124 and a nonoperative position wherein developer roll 104 is spaced from photoconductive surface 12. Suitable drive means (not shown) are provided to swing developer housing 98 forward into developing position, stop 132 serving through engagement with drum 10 to limit movement of housing 98. Conveyor 100 and rolls 102, 104 are rotated by a suitable gear train (not shown).

It will be understood that when the latent image recorded on photoconductive surface 12 has passed the development zone 114, development action is discontinued and the housing 98 is returned by spring 122 to the inoperative position.

Developer roll 104 includes an exterior sleeve 134, preferably aluminum and having an irregular or roughened exterior surface journaled for rotation by suitable bearing means (not shown). Magnets 138 are disposed within sleeve 134. Magnets 138 are normally stationary, but may be rotated during servicing of the machine 8 to enhance operation of developer units 28, 30, 32.

Intermediate transport roll 102 is similar in construction, with a nonmagnetic exterior sleeve 140, preferably aluminum, and having an irregular or roughened exterior surface. Sleeve 140 is journalled for rotation by suitable bearing means (not shown) with relatively stationary magnets 162 supported therewithin.

While developer unit 28 has been described, the construction and operation of developer units 30, 32 are substantially the same.

To enhance development, sleeves 134 of developer units 28, 30, 32 are independently biased to a predetermined potential from a suitable D.C. power source 142. Bias may be conveniently transmitted by means of brush and slip ring type connectors through the sleeve bearing means. A single uniform bias may be applied to each sleeve 134 of development units 28, 30, 32. A typical bias potential is 500 volts D.C. Alternately, individual bias potentials, tailored to the specific working needs of each developer unit 28, 30, 32 may be provided.

To offset the tendency of the bias on magnetic brush sleeves 134 of developer units 28, 30, 32 to set up strong anti-development fields between the white or light background areas of the projected image and the sleeves 134 and enhance control development of line copy and the fringe areas of solids, a field sensitive corotron 200 is provided.

Figure 5:
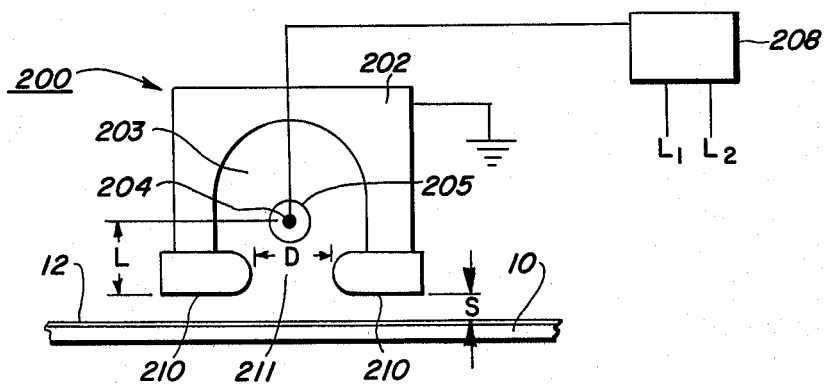
FIG. 5 is an enlarged view in cross section showing details of the field sensitive corotron used in the present invention.

Referring particularly to FIGS. 1 and 5, corotron 200 is located downstream of exposure station B and before development station C. Corotron 200 includes an exterior housing 202 which is comprised of an electrically conductive material having a configuration, when viewed in cross-section, of inverted U-shape. The length of housing 202 is preferably slightly greater than or equal to the width of drum 10, corotron 200 being mounted to extend in transverse spaced relationship thereto. One or more wire-like ion discharge devices, herein illustrated as corona discharge wire 204 is supported within the confines 203 of housing 202 in predetermined spaced relationship with the sides thereof. The support means for corona discharge wire 204 includes suitable insulators 205 to electrically isolate wire 204 from the conductive housing 202. Corona discharge wire 204 is electrically connected to a suitable high voltage power supply 208. Power supply 208 may be either a DC or AC power unit. In the exemplary arrangement shown, power supply 208 comprises a high voltage positive DC source such that corotron 200 charges the photoconductive surface 12 of drum 10 to the same polarity as corona generating device 16.

The open side or mouth 211 of housing 202 through which ions generated by corona wire 204 pass is relatively narrow as compared to the interior dimension of the corotron housing 202. This construction provides a corotron which shows a relatively sharp cutoff in corotron current when the charge potential on the photoconductive surface 12 is at or above a preselected level. Preferably, the relative dimensions of corotron 200 and the spacing of corotron 200 from the surface of drum 10 are chosen to produce the aforesaid cutoff in corotron current at photoconductor charge levels just below the bias potential applied to developer sleeves 134.

Preferably, the dimension (D) across mouth 211 of housing 202 is approximately equal that of the dimension (L) between corona discharge wire 204 and the side 210 of corotron 200 facing drum 10 with the space (S) between corotron 200 and the photoconductive surface 12 relatively small. Typical dimensions are: D = 0.175in.; L = 0.200in.; S = 0.078in.

Figure 6:
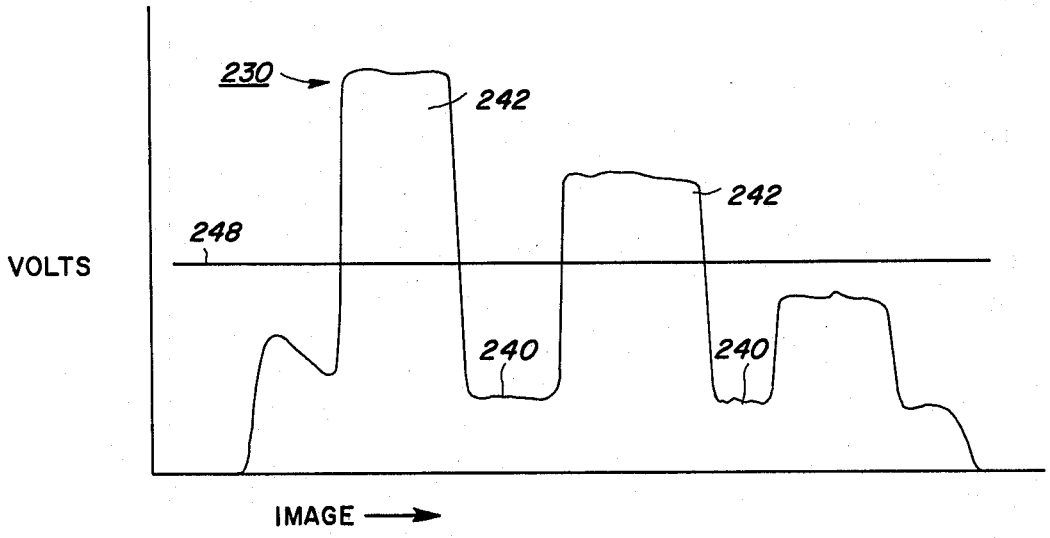
FIG. 6 is a graphical representation of an electrostatic image charge pattern before application of the present invention.

The purpose of corotron 200 is to raise potentials of the background areas to a level just below the bias potential applied to sleeves 134 of developer units 28, 30, 32 yet leave the potentials of the image areas above the bias potential unchanged. Referring to the graphical representations of FIGS. 6 and 7, these illustrate exemplary image charge patterns 230 before and after treatment by corotron 200. Referring to FIG. 6 particularly, the exemplary charge pattern thereshown includes areas 240 of relatively low potential (representing background areas of original document 22 as seen by lens 18) and areas 242 of relatively high potential (representing image areas). As will be understood, background areas 240 are normally light colored portions of the original document, the portions of photoconductive surface 12 corresponding thereto being subjected to full or substantially full exposure. In color systems, the background areas are a function of the particular color filter in use.

As can ben seen from FIG. 6, a relatively large potential difference exists between the developer bias potential, represented by line 248, and the potentials of background areas 240. As described heretofore, this difference is potential tends to create a magnetic field which interferes with full development. This may result in deletion of the trailing edge of a solid area such as 242, bordering a background area 240, color contamination in the lines and edges of solids, and interference due to the buildup of toner on the magnetic brush sleeves 134 with potential loss or degrading of developer control.

Figure 7:
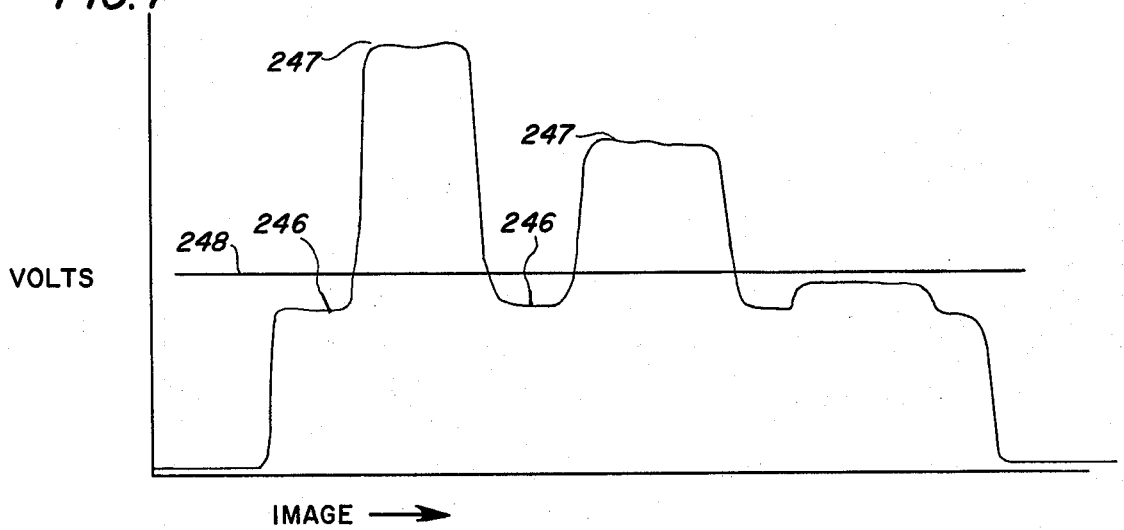
FIG. 7 is a graphical representation of an electrostatic image charge pattern after application of the present invention.

In the present arrangement, as the image comes into operative disposition with field effect corotron 200, corotron 200 responds to the varied image defining charges to raise the potentials of background areas 240 to a value (represented by line 246 in FIG. 7) approximating the bias potential on sleeves 134 of developer units 28, 30, 32 (represented by line 248 in FIG. 7). At the same time, the sensitivity of corotron 200 to electromagnetic fields effectively cuts off or reduces the charging effect on the image areas such as solid area 242. As a result, backgound areas on the photoconductive surface 12 are raised by a relatively large amount while image area potentials (line 247) are raised only slightly. This reduces and in some cases neutralizes the electric field set up between the developer bias potential and image background potentials permitting more effective image development without edge deletion.

While the invention has been described with reference to the structure disclosed, it is not confined to the details set forth, but is intended to cover such modifications or changes as may come within the scope of the following claims.

What is claimed is:

1. In an electrostatic reproduction machine, the combination of a photoconductive member, first charging means to place a uniform electrostatic charge of one polarity on the surface of said photoconductive member in preparation for imaging, exposure means to expose said photoconductive member without changing said one polarity to an original being reproduced and thereby selectively discharge said photoconductive member in accordance with the original being reproduced to form a latent electrostatic image in said one polarity of the original on said photoconductive member, and, second charging means for subjecting said latent electrostatic image formed on said photoconductive member to a charge of said one polarity to restore to said latent electrostatic image at least a part of the charge originally provided on said photoconductive member by said first charging means on the exposed areas of said latent electrostatic image without forming a second image whereby to reduce the charge differential between exposed and non-exposed areas.

2. In an electrostatic reproduction machine, the combination of a photoconductive member, first charging means to place an electrostatic charge of one polarity on the surface of said photoconductive member in preparation for imaging, exposure means to expose said charged photoconductive member without changing said one polarity to an original being reproduced and thereby form a latent electrostatic image in said one polarity of the original on said photoconductive member, developing means to develop said latent electrostatic image, and second charging means to selectively charge exposed areas of said image without forming a second image, the charge provided by said second charging means being of the same polarity as the charge provided by said first charging means whereby the charge differential between exposed and unexposed portions of said image is reduced before development of said image by said developing means.

* * * * *